US010179088B2

(12) United States Patent
Duncan

(10) Patent No.: US 10,179,088 B2
(45) **Date of Patent: *Jan. 15, 2019**

(54) ROTATING CONTROL PANEL

(71) Applicant: Sauna Works Inc., Berkeley, CA (US)

(72) Inventor: Raleigh Duncan, Berkeley, CA (US)

(73) Assignee: Sauna Works Inc., Berkeley, CA (US)

( * ) Notice: Subject to any disclaimer, the term of this patent is extended or adjusted under 35 U.S.C. 154(b) by 0 days.

This patent is subject to a terminal disclaimer.

(21) Appl. No.: 15/617,815

(22) Filed: Jun. 8, 2017

(65) Prior Publication Data

US 2017/0273865 A1 Sep. 28, 2017

Related U.S. Application Data

(63) Continuation-in-part of application No. 13/736,947, filed on Jan. 9, 2013, now Pat. No. 9,775,773.

(60) Provisional application No. 61/585,409, filed on Jan. 11, 2012.

(51) Int. Cl.
*A61H 33/06* (2006.01)
*A61H 33/00* (2006.01)

(52) U.S. Cl.
CPC ..... *A61H 33/066* (2013.01); *A61H 33/005* (2013.01); *A61H 2033/0058* (2013.01); *A61H 2201/5046* (2013.01)

(58) Field of Classification Search
CPC .... A61H 2033/0058; A61H 2201/5046; A61H 33/005; A61H 33/066
USPC ..... 236/94
See application file for complete search history.

(56) References Cited

U.S. PATENT DOCUMENTS

| | | | | |
|---|---|---|---|---|
| 3,092,258 | A * | 6/1963 | Bleed | A47F 5/02 211/163 |
| 3,586,290 | A | 6/1971 | Null | |
| 3,647,180 | A | 3/1972 | Church | |
| 3,797,829 | A * | 3/1974 | Heller | A63F 3/00261 273/271 |
| D261,711 | S * | 11/1981 | Mulvihill | D6/680.2 |
| 4,890,845 | A | 1/1990 | Gatewood | |
| 5,161,321 | A | 11/1992 | Kuhnke | |
| D390,482 | S | 2/1998 | Pasquarette | |

(Continued)

OTHER PUBLICATIONS

"U.S. Appl. No. 13/736,946 Notice of Allowance dated Mar. 8, 2017", 14 pgs.

(Continued)

*Primary Examiner* — Henry Crenshaw
(74) *Attorney, Agent, or Firm* — Kwan & Olynick LLP

(57) ABSTRACT

Disclosed herein are systems, methods, and devices for implementing a rotating control panel. Systems include an enclosed space of a sauna comprising a plurality of walls, an opening in at least one of the plurality of walls, and a control panel configured to be coupled with at least one heating element. The control panel includes an axis of rotation and a plurality of controls. Systems also include a rotating mount coupled with the control panel at the axis of rotation to enable the control panel to rotate at least 180 degrees within the opening of the a wall of the enclosed space of the sauna without disconnecting the at least one electrical connector. Systems include an insulating seal coupled with the control panel and configured to contact the opening when the control panel is coplanar with the wall while allowing the control panel to rotate freely within the opening.

20 Claims, 4 Drawing Sheets

(56) References Cited

U.S. PATENT DOCUMENTS

| | | | | |
|---|---|---|---|---|
| 6,276,001 | B1 * | 8/2001 | Chen | A61H 33/06 4/527 |
| D520,884 | S | 5/2006 | Simon et al. | |
| D558,073 | S | 12/2007 | Simon et al. | |
| D725,524 | S | 3/2015 | Takach et al. | |
| D734,179 | S | 7/2015 | Golden | |
| 2003/0202003 | A1 | 10/2003 | Marmaropoulos | |
| 2004/0027793 | A1 * | 2/2004 | Haraguchi | G06F 1/162 361/679.55 |
| 2004/0103593 | A1 | 6/2004 | Beasley | |
| 2004/0114316 | A1 * | 6/2004 | Carter | B01L 1/02 361/679.29 |
| 2004/0141284 | A1 * | 7/2004 | Chen | G06F 1/162 361/679.27 |
| 2004/0160733 | A1 | 8/2004 | Hsu | |
| 2004/0192220 | A1 | 9/2004 | Huang et al. | |
| 2005/0041171 | A1 * | 2/2005 | Shin | F16M 11/126 349/58 |
| 2006/0006244 | A1 | 1/2006 | Morrow et al. | |
| 2006/0238637 | A1 | 10/2006 | Goto et al. | |
| 2007/0104467 | A1 * | 5/2007 | Wang | G06F 1/162 386/362 |
| 2007/0228183 | A1 * | 10/2007 | Kennedy | F24F 11/0012 236/1 C |
| 2011/0016739 | A1 * | 1/2011 | Beck | B65G 21/2036 34/275 |
| 2014/0191048 | A1 * | 7/2014 | Duncan | A61H 33/005 236/1 C |

OTHER PUBLICATIONS

"U.S. Appl. No. 13/736,946, Non Final Office Action dated Aug. 12, 2017", 14 pgs.

"U.S. Appl. No. 13/736,946, Non Final Office Action dated Aug. 5, 2016", 16 pgs.

* cited by examiner

ROTATING CONTROL PANEL

CROSS-REFERENCE TO RELATED APPLICATIONS

The present application is a continuation-in-part of U.S. patent application Ser. No. 13/736,947, filed Jan. 9, 2013, which claims the benefit of U.S. Provisional Application No. 61/585,409, filed Jan. 11, 2012, which are incorporated herein by reference in their entirety.

FIELD OF THE INVENTION

The present invention relates to control panels, specifically to control panels used to control the environmental factors of an enclosed space.

BACKGROUND OF THE INVENTION

There are many situations in which a control panel would need to be accessible from both inside and outside an enclosed space. One such situation may arise in enclosed spaces where the temperature, humidity, or other environmental parameters are under strict control, such as cleanrooms, art preservation enclosures, high-oxygen enclosures for medical use, steamrooms, or saunas. In such situations, a user may not want to have to enter the enclosed space in order to access the controls on the inside, or, once inside, to have to exit the enclosed space in order to access the controls on the outside. While it is possible to design such an enclosed space to have two sets of controls, one on the inside and one on the outside, it is expensive and unnecessarily duplicative.

This problem is especially applicable to saunas, since once a user is relaxing inside a sauna, he or she may not want to have to exit the sauna in order to change the temperature; on the other hand, if a user wants to set the temperature in a sauna ahead of time, he or she may not want to enter the sauna wearing shoes and regular street clothes.

It may also be unsafe to have a sauna where the temperature is only controllable from the outside. If the door to the sauna gets stuck or jammed, and the user is unable to exit the sauna, he or she has no way to turn off the heating unit.

One solution to the problem, as it pertains to saunas, is described in U.S. Pat. No. 4,384,190 to Janson. Janson discloses a control panel arrangement for a sauna heating unit that can be operated from either inside or outside the sauna; it comprises a temperature control knob and an on-off switch on the outside of the sauna that are connected to shafts going through a special air channel into the inside of the sauna, enabling the user to control the temperature knob or the on-off switch from inside the sauna as well. While this invention solves the problem, it is complex and cumbersome.

Modern touchscreen panels are much easier and more convenient to use than control knobs, and some sauna designs do incorporate touchscreen control panels. However, most such saunas only offer one touchscreen control panel on the outside of the sauna, or two touchscreens, one on the inside and one on the outside. The first is unsafe and inconvenient for the user, and the second is expensive and unnecessarily complex.

A need therefore exists for a way to control an enclosed space with one control panel that can be accessed from either inside or outside the space.

SUMMARY OF THE INVENTION

The present invention allows a user to control the parameters of an enclosed space from either the inside or the outside. The control panel is positioned within a cutout in the wall of the enclosed space, and mounted on a rotating mount. The user can then rotate the control panel to face either the inside or the outside of the enclosed space.

While in the preferred embodiment, the enclosed space is a sauna, the invention is applicable to other enclosed spaces such as cleanrooms, high-oxygen chambers for medical use, climate controlled art preservation spaces, and similar spaces where some environmental parameters are strictly controlled.

The rotating mount may comprise a tube through which cables pass to the control panel, slip rings or rotating electrical connectors to connect the control panel electrically to the enclosed space, or other connectors known in the art that enable the control panel to be electrically connected to the enclosed space while still rendering it able to rotate at least 180 degrees around its axis. The control panel may also be wirelessly connected to the enclosed space.

The axis of rotation of the control panel may be horizontal, vertical, diagonal, or directed in any other direction as long as it enables the control panel to rotate freely around that axis without interference from the cutout within the wall, and to substantially cover the cutout when either facing in or facing out.

In some embodiments of the invention, either the control panel or the cutout may have an insulating seal mounted around their perimeter, to make sure that the air within the enclosure does not intermix with outside air when the control panel is either facing in or facing out. The seal is preferably made of weatherstripping material, but may be any other sealing material.

The control panel may be rectangular, circular, or any other shape as long as the shape is symmetrical around the axis of rotation. In one embodiment of the present invention, the control panel is shaped like a portion of a sphere cut off by a plane, with the touchscreen or other controls located on the planar portion of the shape. This enables the control panel to fit more tightly in the cutout, making a more airtight connection.

DETAILED DESCRIPTION OF THE PREFERRED EMBODIMENT

Figure 1:
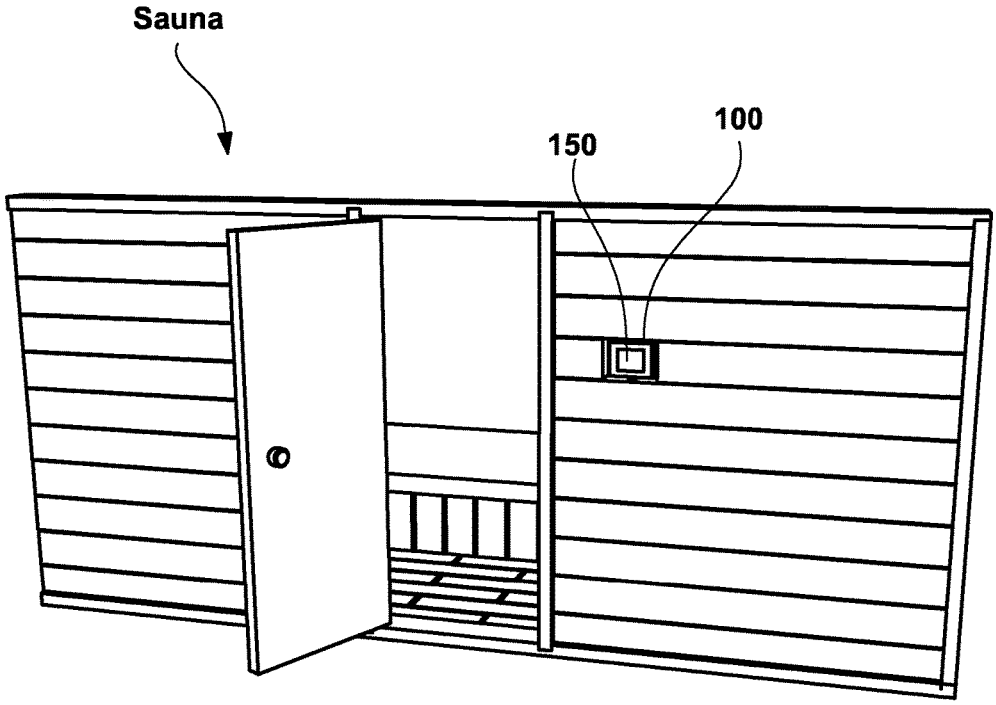
FIG. 1 shows a global view of the control panel of the present invention.

FIG. 1 shows a global view of the preferred embodiment of the present invention. Control panel 100 is set within a cutout of the wall of the enclosed space, shown as a sauna in the Figure. Touchscreen 150 is shown on the control panel 100. In the position shown in the figure, touchscreen 150 is accessible from the outside of the sauna. In various embodiments, touchscreen 150 and control panel 100 may be configured as a device that is configured to display various media, such as entertainment media. Accordingly, a user may view such media, which may be streaming programing, on touchscreen 150.

Figure 2:
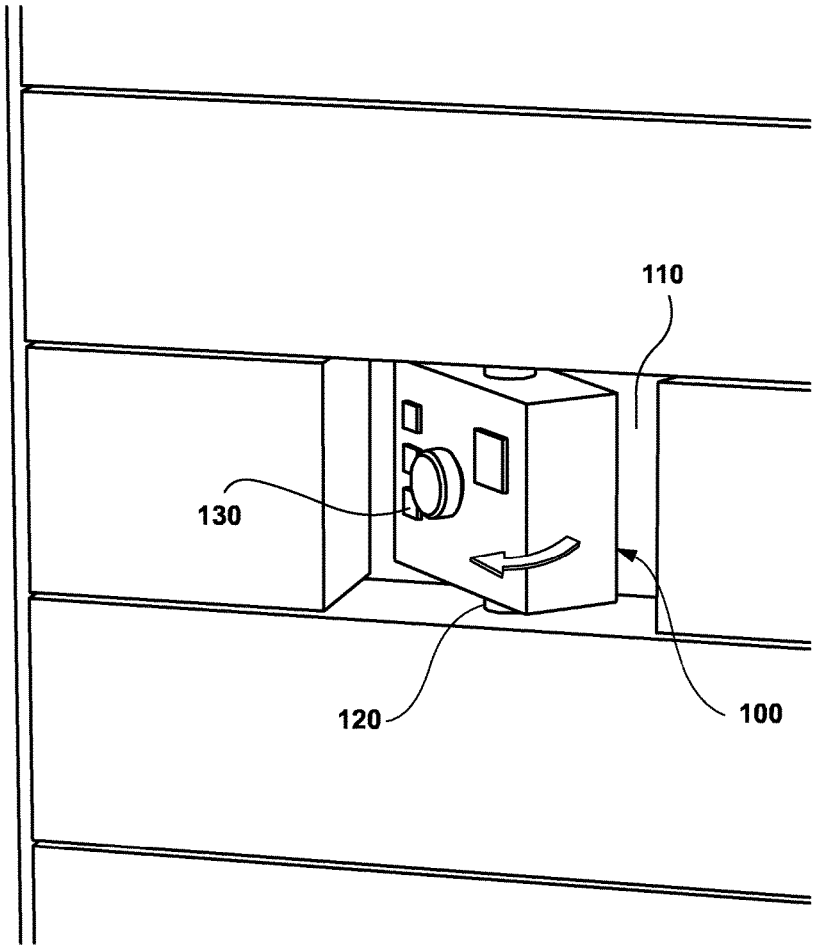
FIG. 2 shows a close up view of the control panel of the present invention.

FIG. 2 shows a close-up view of an embodiment of the present invention, shown in mid-rotation. Control panel 100 is set within a cutout 110 within the wall of an enclosed space. In the alternate embodiment shown in FIG. 2, control panel 100 comprises various controllers 130 such as knobs and buttons and sliders. As discussed above, the control panel 100 can also comprise a touchscreen or any other means of controlling the desired variables. Rotating mount 120 is attached to the control panel 100 and the cutout 110, rendering the control panel 100 able to rotate around its axis within the cutout 110. The control panel may rotate within the range of 180 degrees, or may rotate freely, depending on what type of rotating mount 120 is used; if slip rings or rotating electrical connectors are used, the control panel may rotate freely, whereas if a tube is used through which cables are passed, the control panel may only be able to rotate through a limited angle.

The control panel 100 may comprise controllers for any environmental parameters or any other parameters that the user may desire to control. In the preferred embodiment, the enclosed space is a sauna and the control panel 100 comprises temperature, humidity, and timer controls.

In various embodiments, the control panel 100 may be configured to control one or more heating elements which may be configured to emit one or more infrared spectrums. For example, such heating elements may be configured to emit one of the following infrared wavelength ranges: near infrared, mid infrared, and far infrared. In some embodiment, the heating elements may be configured to emit all three infrared wavelength ranges simultaneously. For example, the heating element may be a halogen based heating element that simultaneously emits near infrared, mid infrared, and far infrared from a single heating device.

In some embodiments, control panel 100 may be configured to swivel or rotate such that a face or side of control panel 100 that includes touchscreen 150 is viewable from either inside or outside of the enclosed space. Accordingly, control panel 100 may be configured to enable a full 360 degrees of rotation.

According to some embodiments, control panel 100 may also be configured to identify and modify one or more parameters associated with an enclosure, such as a sauna. In various embodiments, such parameters may be conditions, such as environmental conditions associated with such an enclosure. For example, the parameters may be temperature, humidity, light, sound, tactile vibration, voltage and amperage, magnetic flux of components, as well as temperature of components inside the sauna. Accordingly, control panel 100 may be configured as a diagnostic and safety device, that may detect one or more conditions or threshold crossings associated with such parameters, and may implement one or more actions based on the occurrence of such conditions, such as the switching off of a component.

In various embodiments, control panel 100 may be coupled with other components in closed-loop configuration in which control panel 100 may be configured to identify a designated condition or parameter, and implement one or more actions or modifications responsive to the identification of such condition or parameter. Accordingly, control panel 100 may be configured to change various features of a sauna such as, but not limited to, operation of heaters of varying types, lights, vapor producing elements, sound systems, vibration systems, electrical switches, dimmer switches, magnetic actuator position, air pressure, mist producing systems, electrical window frosting/tinting. In various embodiments, control panel 100 may be configured to adjust the condition or parameter back into a specified set point that may be defined by preset control points.

In various embodiments, control panel 100 may include or be coupled with one or more sensors that may be implemented as a sensor array. In various embodiments, such a sensor array may be configured to facilitate program control of components, and provide sensory input to control panel 100 to either enhance utilization of components of the sauna, keep heating elements within a safe operating condition or parameter, and/or detect patterns and fluctuations that identify a need for component repair or replacement. In various embodiments, such sensors may include, but not be limited to: temperature sensors, humidity sensors, electrical sensors, position sensors, impedance sensors, level sensors, proximity sensors, chemical sensors, force sensors, density sensors, presence sensors, and infrared sensors.

Figure 3:
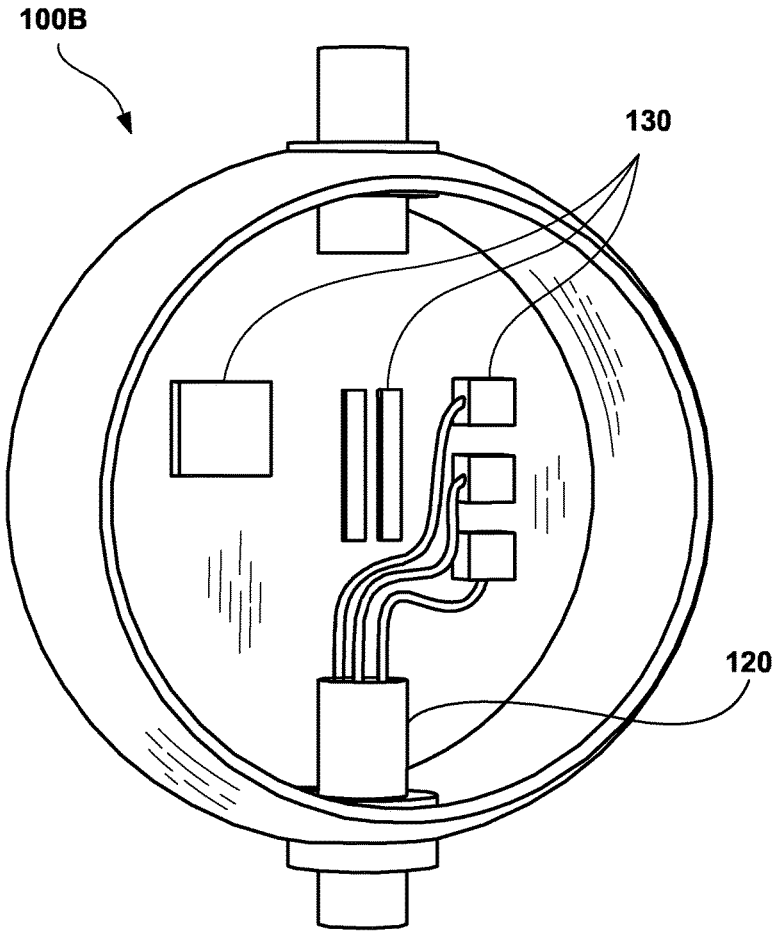
FIG. 3 shows an alternate embodiment of the control panel of the present invention, shown from the back with the back panel taken off

FIG. 3 shows an alternate embodiment of the control panel of the present invention, shown from the back with the back panel taken off. Controllers 130 are connected by wires to the enclosed space, and the wires are passed through a tube in the rotating mount 120. In this embodiment, the control panel is shaped like a sphere cut off by two planes, with the controls located on the planar portion. This enables the control panel to be rotated without creating too much of an open space during the rotation for the air to pass into the enclosed space from the outside.

Figure 4:
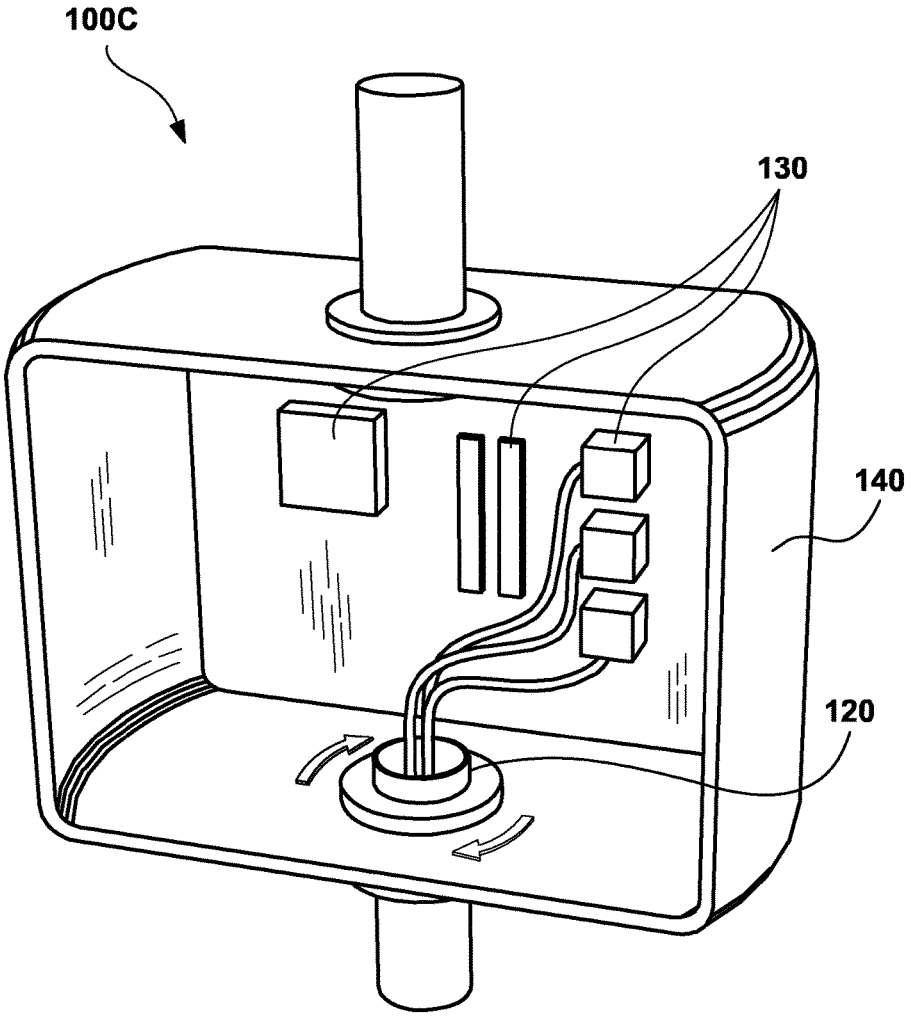
FIG. 4 shows another alternate embodiment of the control panel of the present invention, also shown from the back with the back panel taken off.

FIG. 4 shows another alternate embodiment of the control panel of the present invention, also shown from the back with the back panel taken off. In this embodiment, the control panel is shaped like a cylinder cut off by two planes, with the controls located on the planar portion. This also enables the control panel to be rotated without creating too much of an open space during rotation, but allows the control panel to be roughly rectangular in shape and the cutout to be rectangular.

While it is not shown in the Figures, either the control panel or the cutout can have insulation attached to its perimeter, to prevent air from passing through the gap between the control panel and the walls of the cutout while the control panel is in place (i.e. facing either inward or outward). The insulation can be made out of foam, foam rubber, or any other insulation material known in the art.

What is claimed is:

1. A system comprising:

an enclosed space of a sauna comprising a plurality of walls;

an opening in at least one of the plurality of walls of the enclosed space;

a control panel configured to be coupled with at least one heating element via at least one electrical connector, the control panel comprising an axis of rotation and a plurality of controls configured to control operation of the at least one heating element;

a rotating mount coupled with the control panel at the axis of rotation to enable the control panel to rotate at least 180 degrees within the opening of the wall of the enclosed space of the sauna without disconnecting the at least one electrical connector; and an insulating seal coupled with the control panel and configured to contact the opening when the control panel is coplanar with the wall while allowing the control panel to rotate freely within the opening.

2. The system of claim 1, wherein the enclosed space is a climate controlled enclosed space configured to maintain a temperature and a humidity.

3. The system of claim 1, wherein the control panel is further configured to display entertainment media and streaming media.

4. The system of claim 3, wherein the control panel is a touchscreen.

5. The system of claim 1, wherein the at least one heating element is configured to emit one of: near infrared wavelengths, mid infrared wavelengths, and far infrared wavelengths.

6. The system of claim 1, wherein the at least one heating element is configured to simultaneously emit all of near infrared wavelengths, mid infrared wavelengths, and far infrared wavelengths.

7. The system of claim 1, wherein where the rotating mount comprises rotating electrical connectors.

8. The system of claim 1, wherein the control panel further comprises a front side, a back side, a top, a bottom, and at least two sides, wherein the control panel is symmetrical around a plane equidistant from the front side and back side, wherein the at least two sides are curved in such a way that the radius of curvature is approximately equal to the distance between each one of the at least two sides and the axis of rotation.

9. The system of claim 1, wherein the rotating mount comprises at least one hollow tube through which cables are routed to the control panel.

10. A device comprising:

a control panel configured to be coupled with at least one heating element via at least one electrical connector, the control panel comprising an axis of rotation and a plurality of controls configured to control operation of the at least one heating element;

a rotating mount coupled with the control panel at the axis of rotation to enable the control panel to rotate at least 180 degrees within an opening of a wall of an enclosed space of a sauna without disconnecting the at least one electrical connector; and an insulating seal coupled with the control panel and configured to contact the opening when the control panel is coplanar with the wall while allowing the control panel to rotate freely within the opening.

11. The device of claim 10, wherein the control panel is further configured to display entertainment media and streaming media, and wherein the control panel is a touchscreen.

12. The device of claim 10, wherein the at least one heating element is configured to emit one of: near infrared wavelengths, mid infrared wavelengths, and far infrared wavelengths.

13. The device of claim 10, wherein the at least one heating element is configured to emit all of near infrared wavelengths, mid infrared wavelengths, and far infrared wavelengths simultaneously.

14. The device of claim 10, wherein where the rotating mount comprises rotating electrical connectors.

15. The device of claim 10, wherein the control panel further comprises a front side, a back side, a top, a bottom, and at least two sides, wherein the control panel is symmetrical around a plane equidistant from the front side and back side, wherein the at least two sides are curved in such a way that the radius of curvature is approximately equal to the distance between each one of the at least two sides and the axis of rotation.

16. The device of claim 10, wherein the rotating mount comprises at least one hollow tube through which cables are routed to the control panel.

17. A system comprising:

an enclosed space of a sauna comprising a plurality of walls;

an opening in at least one of the plurality of walls of the enclosed space;

a plurality of heating elements coupled to the plurality of walls;

a control panel configured to be coupled with the plurality of heating elements via a plurality of electrical connectors, the control panel comprising an axis of rotation and a plurality of controls configured to control operation of the plurality of heating elements;

a rotating mount coupled with the control panel at the axis of rotation to enable the control panel to rotate at least 180 degrees within the opening of the wall of the enclosed space of the sauna without disconnecting the at least one electrical connector; and an insulating seal coupled with the control panel and configured to contact the opening when the control panel is coplanar with the wall while allowing the control panel to rotate freely within the opening.

18. The system of claim 17, wherein at least one of the plurality of heating elements is configured to emit all of near infrared wavelengths, mid infrared wavelengths, and far infrared wavelengths simultaneously.

19. The system of claim 17, wherein the control panel is further configured to display entertainment media and streaming media.

20. The system of claim 17, wherein the control panel further comprises a front side, a back side, a top, a bottom, and at least two sides, wherein the control panel is symmetrical around a plane equidistant from the front side and back side, wherein the at least two sides are curved in such a way that the radius of curvature is approximately equal to the distance between each one of the at least two sides and the axis of rotation.

* * * * *